US008915393B2

(12) United States Patent
Hayton et al.

(10) Patent No.: US 8,915,393 B2
(45) Date of Patent: Dec. 23, 2014

(54) CHILD RESISTANT CONTAINER

(75) Inventors: Paul Hayton, Bristol (GB); Philip Walsh, Bristol (GB); Tom Walker, Bristol (GB); Christopher Althorpe, Bristol (GB)

(73) Assignee: Archimedes Development Ltd., Bristol (GB)

( * ) Notice: Subject to any disclaimer, the term of this patent is extended or adjusted under 35 U.S.C. 154(b) by 145 days.

(21) Appl. No.: 13/147,746

(22) PCT Filed: Feb. 4, 2010

(86) PCT No.: PCT/GB2010/000209

§ 371 (c)(1), (2), (4) Date: Nov. 21, 2011

(87) PCT Pub. No.: WO2010/089562

PCT Pub. Date: Aug. 12, 2010

(65) Prior Publication Data

US 2012/0055929 A1 Mar. 8, 2012

(30) Foreign Application Priority Data

Feb. 4, 2009 (GB) ..... 0901806.0

(51) Int. Cl.

| | |
|---|---|
| ***B65D 45/16*** | (2006.01) |
| ***B65D 43/16*** | (2006.01) |
| ***B65D 50/04*** | (2006.01) |
| ***B65D 25/10*** | (2006.01) |

(52) U.S. Cl.

CPC ..... *B65D 50/045* (2013.01); *B65D 50/04* (2013.01); *B65D 2251/1066* (2013.01); *B65D 25/103* (2013.01); *B65D 43/162* (2013.01); *B65D 2251/1058* (2013.01)

USPC ..... 220/326; 220/4.23; 220/835; 220/839

(58) Field of Classification Search

USPC ..... 220/4.22, 4.24, 326, 833–835, 839

See application file for complete search history.

(56) References Cited

U.S. PATENT DOCUMENTS

| | | | | |
|---|---|---|---|---|
| 3,429,424 | A | 2/1969 | Dow | |
| 4,889,238 | A | 12/1989 | Batchelor | |
| 2007/0023317 | A1 * | 2/2007 | Brozell et al. | 206/538 |

FOREIGN PATENT DOCUMENTS

| | | | |
|---|---|---|---|
| DE | 15 86 578 | A1 | 5/1970 |
| WO | WO-96/25966 | A1 | 8/1996 |
| WO | WO-97/48615 | A1 | 12/1997 |
| WO | WO-2007/065240 | A1 | 6/2007 |

OTHER PUBLICATIONS

International Preliminary Report on Patentability Under Chapter I of corresponding International Patent Application No. PCT/GB2010/000209 mailed Aug. 18, 2011 (6 pages).

* cited by examiner

*Primary Examiner* — Fenn Matthew
*Assistant Examiner* — James N Smalley
(74) *Attorney, Agent, or Firm* — Giordano and Chavous LLC

(57) ABSTRACT

A child resistant container (10) has a container cavity (20) for the receipt of one or more items to be stored therein. The container cavity (20) is defined by a pair of lids (14, 16) which are hingedly connected to one another. Primary lock means (50) includes a first lock assembly on one lid (14, 16) which engages with a second lock assembly on the other lid (14, 16). A primary lock actuation includes an externally open topped pocket (60) formed in the body of said one lid (14, 16). The pocket (60) has a pocket side wall (62) which is resiliently deflectable from a lock position to an unlock position. The pocket (60) is shaped and sized to permit a finger of an operative to enter the pocket (60) to effect deflection of the pocket side wall (62) to its unlock position.

5 Claims, 4 Drawing Sheets

CHILD RESISTANT CONTAINER

This application claims the benefit of International Application No. PCT/GB2010/000209, filed Feb. 4, 2010, which claims the benefit of priority of GB0901806.0, filed Feb. 4, 2009, the contents of both of these applications are hereby incorporated herein in their entirety.

The present invention relates to a child resistant container.

In particular, but not exclusively, the invention relates to a child resistant container which is intended to safely house medicines which if taken by children could prove health threatening.

According to one aspect of the present invention there is provided a child resistant container having a container cavity for the receipt of one or more items to be stored therein, the container cavity being defined by a pair of lids hingedly connected to one another at one end for hingeable movement between a container open condition and a container closed condition, one or both of said lids having a body of dished form so as to define said cavity when positioned in said container closed condition, primary lock means for releasably locking the lids in said container closed condition, the primary lock means including a first lock assembly on one lid which lockingly engages with a co-operating second lock assembly on the other lid, and primary lock actuation means for manually actuating disengagement of the first and second lock assemblies, the actuation means including an externally open topped pocket formed in the body of said one lid, the pocket having a pocket side wall which at least in part, in relation to the pocket, is outwardly resiliently deflectable from a lock position to an unlock position, the pocket side wall in said lock position maintaining locking engagement of said first and second lock assemblies, the pocket side wall on movement to said unlock position causing disengagement of the first and second lock assemblies to thereby permit the lids to be moved to the container open condition, said pocket being shaped and sized to permit a finger of an operative to enter the pocket to effect deflection of the pocket side wall to its unlock position.

In accordance with a preferred embodiment of the invention the primary lock actuation means includes a pair of said pockets positioned side by side with the deflectable side wall of one pocket being located adjacent to the deflectable side wall of the other pocket.

Various aspects of the present invention are hereinafter described with reference to the accompanying drawings, in which.

A child resistant container 10 according to a first embodiment of the present invention is shown schematically in FIGS. 1 to 6 and for the purpose of illustration, the container 10 is adapted to contain a nasal dispenser 12. The nasal dispenser 12 may contain a hazardous medicine, e.g. an opioid analgesic medicine, which if taken by a child could prove health threatening. It is however to be appreciated that the container 10 could be adapted to house other 'dangerous' medicines or articles which could be harmful to children.

Figure 3:
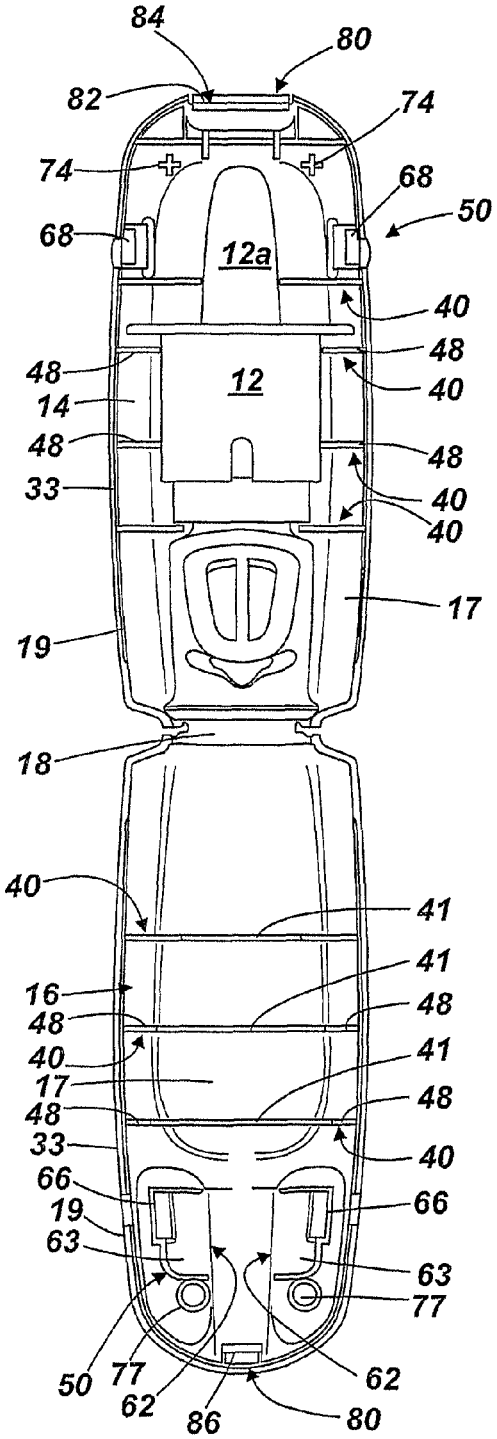
FIG. 3 is a plan view of the container of FIG. 1 shown in an open condition and housing a nasal dispenser.
Figure 1:
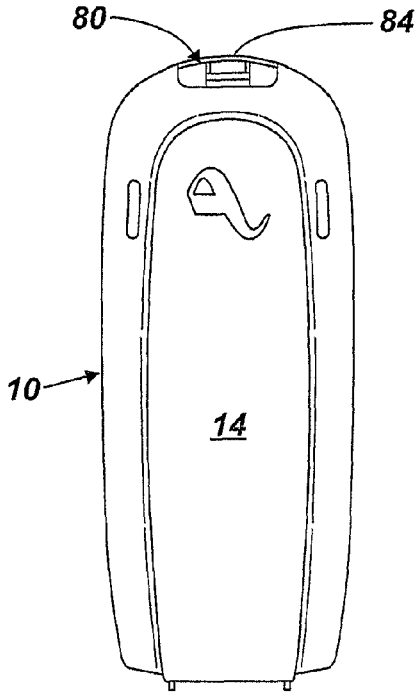
FIG. 1 is a top plan view of a container according to a first embodiment of the present invention shown in a closed condition.
Figure 2:
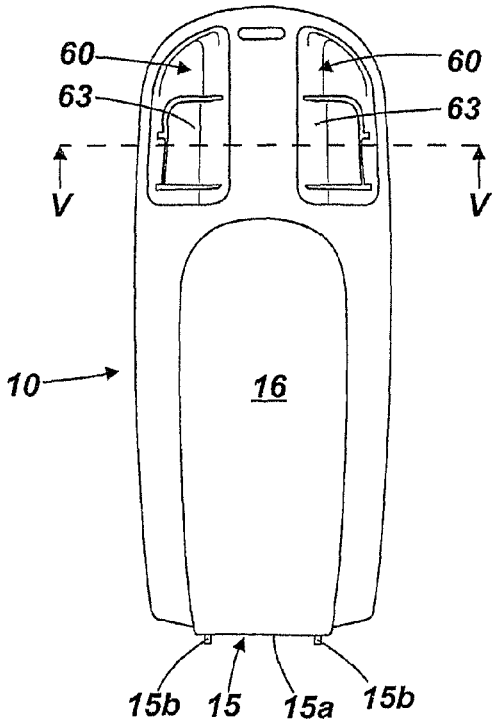
FIG. 2 is a bottom plan view of the container as shown in FIG. 1.
Figure 4:
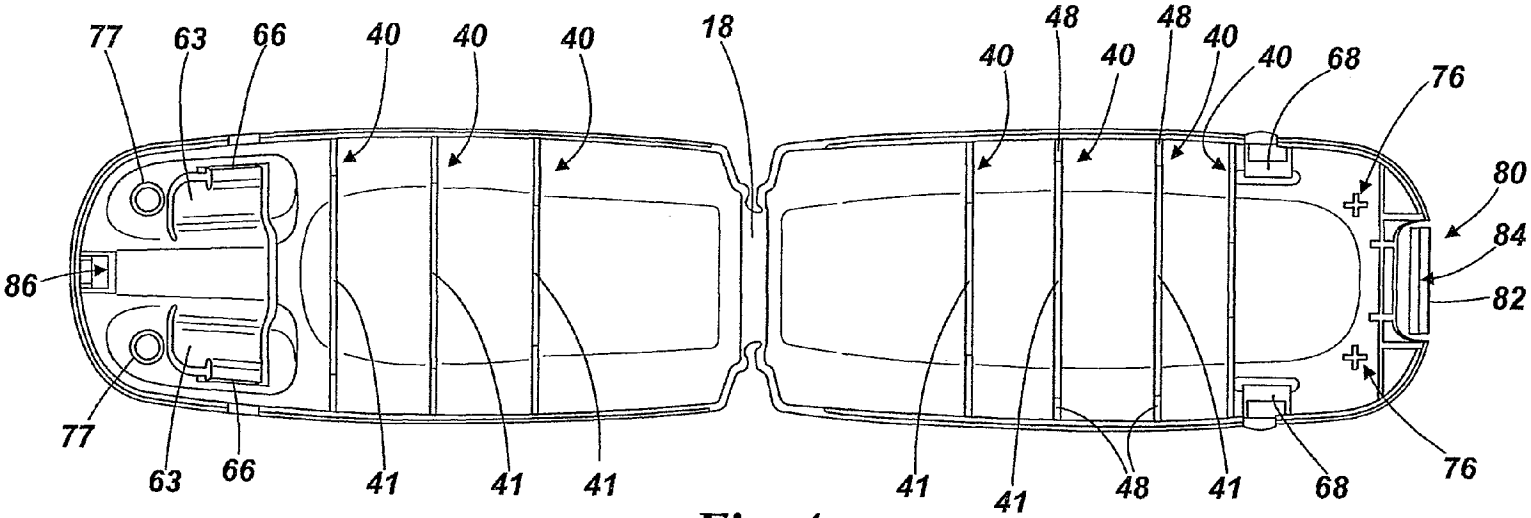
FIG. 4 is a plan view of the container as shown in FIG. 3 but without the nasal dispenser.

The container 10 is of 'clam-shell' form having an upper lid 14 and a lower lid 16 hingedly connected to one another by a hinge 18. The hinge 18 enables the lids 14, 16 to be hingedly moved from a closed condition as shown in FIGS. 1 and 2 and an open condition as shown in FIGS. 3 and 4.

Each lid 14,16 is of dished form defined by a bottom wall 17 surrounded by an upstanding peripheral wall 19. In the illustrated embodiment, each lid 14, 16 is of elongate form (generally rectangular when viewed in plan as seen for example in FIG. 4) with the hinge 18 being located at one end of each lid 14, 16.

In the closed condition, the lids 14, 16 overlie one another with the top edges 33 of respective peripheral walls 19 in abutment. The lids define therebetween a totally enclosed container cavity 20 for housing the nasal dispenser 12. Accordingly, when the nasal dispenser 12 is located within the container cavity 20 it is inaccessible, i.e. access to the nasal dispenser 12 can only be achieved by opening the container 10 to its open condition.

Preferably, the peripheral wall 19 in the region of hinge 18 is formed to define a foot support 15 to enable the container 10, when closed, to stand upright on a flat surface such as a shelf. This is desirable to provide the option of upright storage of the dispenser 12 when not in use. Advantageously, the support foot 15 is defined by a relatively planar portion 15*a* of the peripheral wall 19, the planar portion being preferably provided with external ribs 15*b* for engaging a support surface.

Figure 5:
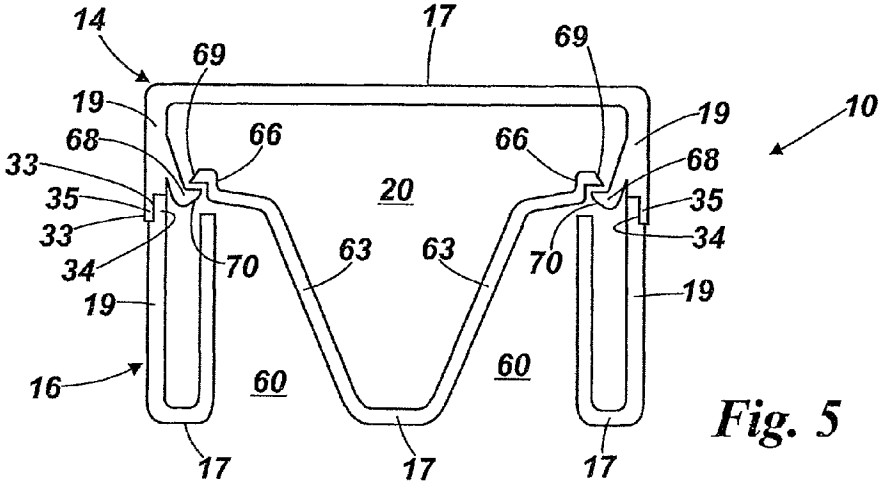
FIG. 5 is a cross-sectional view taken along line V-V in FIG. 2.
Figure 7:
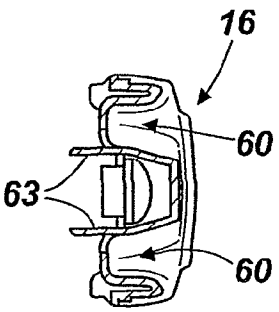
FIG. 7 is a sectional view taken along line A-A in FIG. 6.
Figure 6:
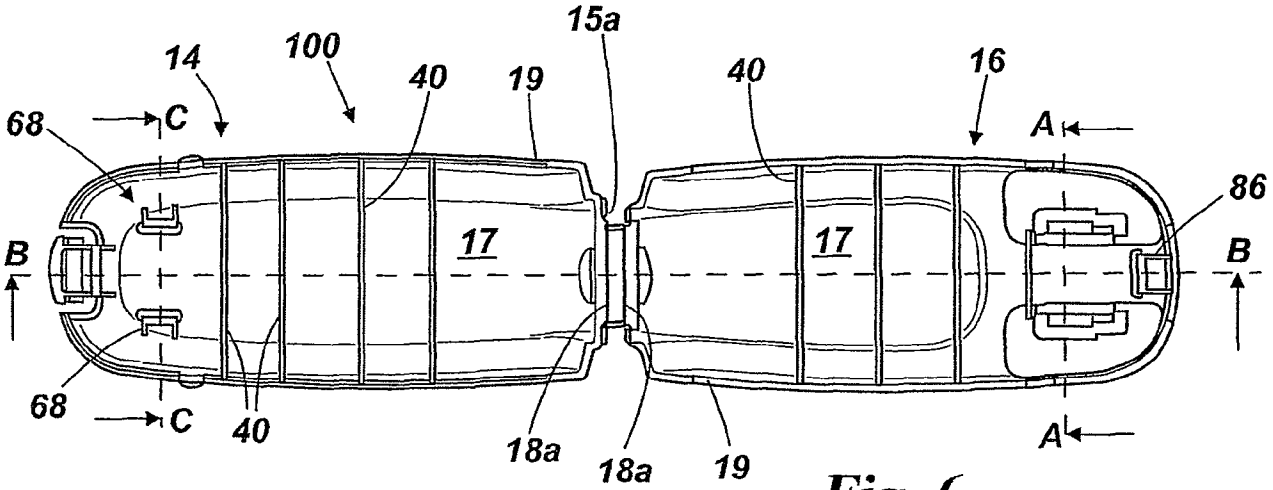
FIG. 6 is a plan view of a container according to a second embodiment of the invention.
Figure 8:
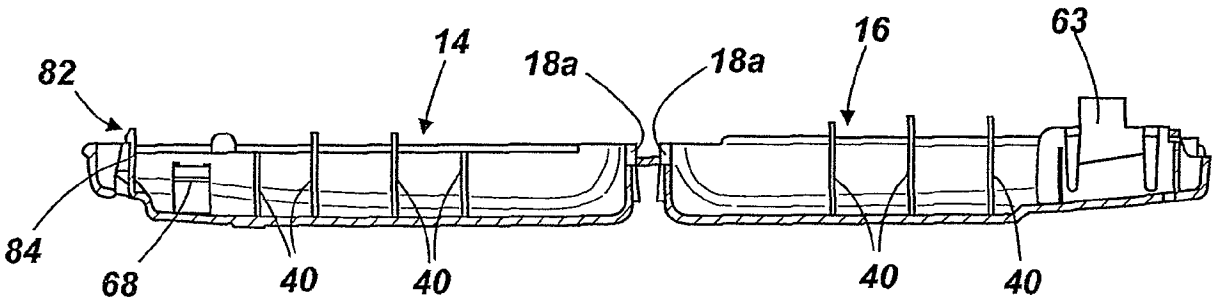
FIG. 8 is a sectional view taken along line B-B in FIG. 6.
Figure 10:
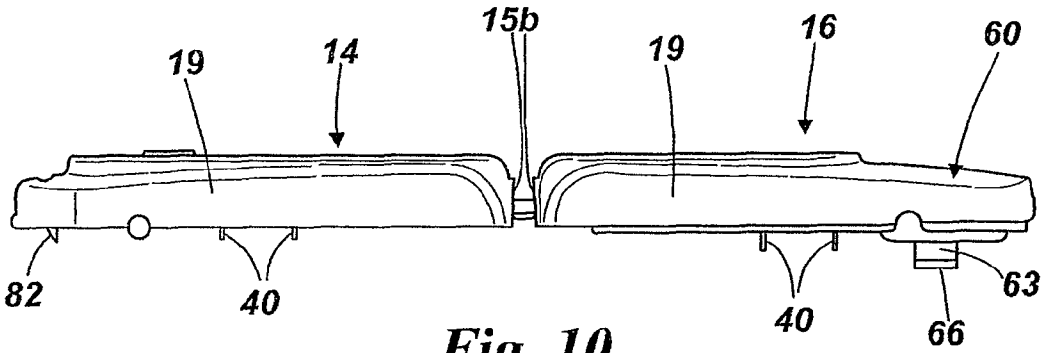
FIG. 10 is a side view of the container shown in FIG. 6.
Figure 9:
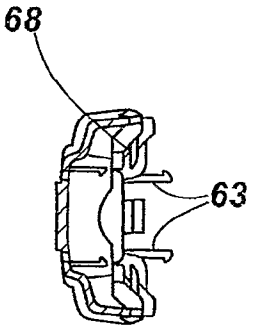
FIG. 9 is a sectional view taken along line C-C in FIG. 6.
Figure 11:
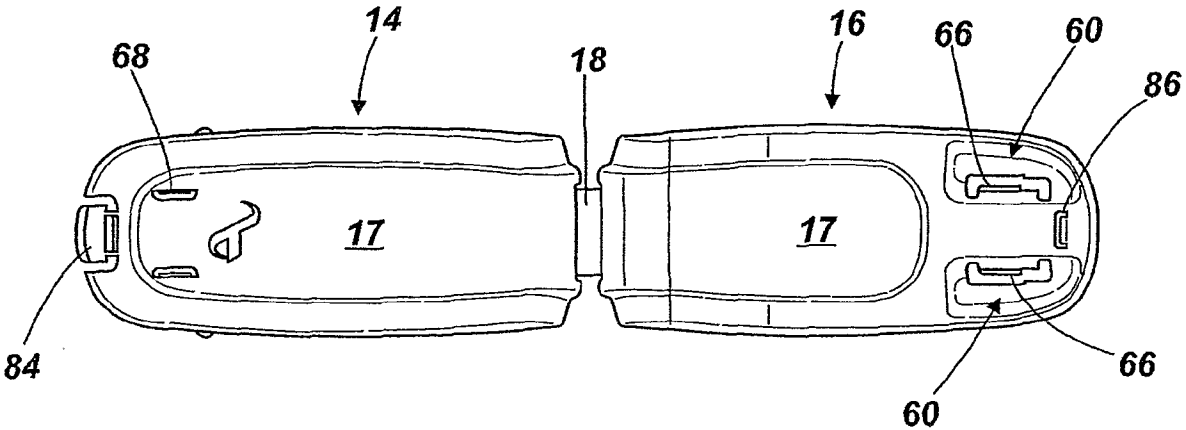
FIG. 11 is a plan view from below of the container shown in FIG. 6.

Preferably, as illustrated in FIG. 5, the top edge 33 of each peripheral wall 19 is stepped to define on one wall 19 an inner peripherally extending flange 34 and on the other wall 19 an outer peripherally extending flange 35. In the closed condition, the flanges 34, 35 lie side by side and co-operate to act as mutual stops to resist lateral movement of the lids 14,16 relative to one another when in the closed condition.

Preferably each lid 14,16 is provided with internal laterally extending reinforcement ribs 40 spaced apart along the length of the lid 14,16. The ribs 40 serve to reinforce the structure of each lid and in particular provide resistance to inward deflection of the peripheral wall 19 relative to the bottom wall 17.

Preferably the reinforcement ribs 40 of each lid are adapted, for instance by the provision of suitably shaped recesses 41, to collectively define a cradle for positively locating and mounting the contents, such as the nasal dispenser 12, within the container 10 in spaced relationship to the bottom wall 17 and peripheral wall 19 of each lid. Accordingly, when located within the cavity 20 the nasal dispenser 12 is held against movement relative to the container and is protected from damage by impacts on the outside of the container 10 (e.g. as would happen if the container were dropped onto a hard surface).

Preferably one or more of the reinforcement ribs 40 on each lid 14, 16 has side projections 48 which project beyond the top edge 33 of the peripheral side wall 19 of its lid 14, 16. The side projections 48, in the closed condition of the container 10, are arranged to lie in face contact with the inner face of the peripheral side wall 19 of the opposite lid 14, 16. This arrangement provides additional resistance to relative lateral displacement of the lids 14, 16 in the closed condition of the container 10, and so adds to the rigidity of the container structure.

When in its closed condition, the lids 14, 16 are locked together by primary lock means 50 which acts to prevent relative movement of the lids 14, 16 about hinge 18.

The lock means 50 is preferably located adjacent to the end of the lids 14, 16 opposite to the end having hinge 18 in order to provide a high resistance to opening of the lids 14, 16 about hinge 18.

The primary lock means 50 includes first and second latch assemblies which latchingly engage with one another to maintain the lids 14, 16 locked in a closed condition. The first latch assembly is formed by a pair of hook shaped first latch members 66 movably mounted on the lower lid 16. The second latch assembly is formed by a pair of hook shaped second latch members 68 fixedly mounted on the upper lid 14.

Manual lock actuation means are provided in the form of a pair of side by side externally open topped pockets 60 formed in the bottom wall 17 of the lower lid 16. Each pocket 60 has a side wall 62 at least a portion of which, in relation to the pocket, is outwardly resiliently deflectable. In the illustrated embodiment, the portion of side wall 62 which is resiliently deflectable is a tongue 63. Each tongue 63 has mounted thereon one of the hook shaped latch members 66.

In the container closed condition, each first latch member 66 latchingly engages with a hook shaped second latch member 68 fixedly mounted on lid 14.

The co-operating latch members 66, 68 can be manually disengaged by deflecting the tongue 63 of each pocket; such deflection moves the first latch member 66 sideways out of engagement with co-operating second latch member 68. Each pocket 60 is shaped and sized to enable an operative to insert a finger or thumb into the pocket 60 to effect deflection of the tongue 63.

Preferably the pockets 60 are arranged side by side such that the side wall 62 of one pocket 60 lies adjacent to the side wall 62 of the other pocket 60. Such an arrangement is advantageous in that it provides a pinching grip (e.g. between thumb and finger) for an operative to facilitate gripping of the upper lid 14 to move it to its open position while simultaneously the operative holds the tongues 63 of sidewalls 62 in their deflected, lock disengaging, position.

Advantageously, the spacing between sidewalls 62 is chosen such that a nozzle 12*a* of the nasal dispenser 12 may be located therebetween. A predetermined clearance space is left between the nozzle 12*a* and sidewalls 62 which permits the tongues 63 to be deflected outwardly of their respective pockets. Advantageously this clearance space enables the nozzle 12*a* to act as a limit stop for inward deflection of the tongues 63.

Preferably the latch members 66, 68 have co-operating cam faces 69,70 which interengage on moving the lids 14,16 to their closed position to cause deflection of the sidewall tongues 63 such that the latch members 66,68 automatically latching engage when the lids 14, 16 are closed together.

In the illustrated embodiment, the upper lid 14 is provided with a pair of shaft like projections 76 which telescopically engage with a pair of tubular projections 77 mounted on the lower lid 16. The projections 76, 77 inter engage as the lids 14, 16 move towards the closed position prior to cam faces 69,70 engaging. The projections 76, 77 thereby guide the lids 14, 16 into the final closing position and serve to resist relative lateral displacement of the lids 14, 16 as the latch members 66, 68 engage with one another. The projections 76, 77 are advantageous but are not essential to the invention.

The provision of the lock actuating sidewalls 62 within a pocket serves to shield the sidewalls from accidentally deflection (resulting in unintentional opening of the container) and so makes it unlikely for a child to accidentally open the container. In addition the pockets 60 in effect 'hide' the sidewalls 62 in a child's eyes and render it less intuitive for them to operate the primary lock means.

Preferably a secondary lock means 80 is provided. The secondary lock means 80 includes a third latch member 82 mounted on a resiliently deflectable tongue 84 which is externally located on the upper lid 14. A fixed co-operating fourth latch member 86 is fixedly mounted on the lower lid 16 for locking engagement with the third latch member 82. The secondary lock means 80 is unlocked by deflecting the tongue 84 inwards of the container 10.

The secondary lock means 80 is independent of the primary lock means 50 and so both lock means need to be operated independently in order to enable the lids 14, 16 to be moved to the container open condition. This arrangement is advantageous in that it requires an operative to use two hands in order to open the container 10 to its open condition and so makes it even more unlikely for a child to open the container 10 (due to the difficulty of requiring a child to use two hands to open the container).

The container 10 is preferably made in one piece from a suitable resilient plastics material which provides the desired amount of resilience for sidewall tongues 63 and tongue 84 and desired amount of flexure for hinge 18.

Turning now to FIGS. 6 to 11, a container according to a second embodiment of the invention is designated generally by the reference numeral 100. The container 100 is of similar construction to container 10 described above and similar parts have been given corresponding reference numerals for each of understanding.

A difference between container 10 and container 100 is that the hinge 18 in container 100 is a double hinge, i.e. it has two hinge formations 18*a*.

A further difference resides in container 100 not having projections 76,77

In the above embodiments, the sidewall 62 is formed in part by a resilient tongue 63; it will be appreciated that the entire sidewall 62 may be in the form of a tongue or adapted to be resiliently deflectable inwardly in some other way in order to actuate the primary lock 50. For example the wall 62 may be continuous with the remainder of the walls forming the pocket but may be resiliently deflectable by deformation.

In the container 100, the sidewall tongues 63 are extended in length compared to the tongues 63 in container 10.

In the above embodiments two pockets 60 are provided having an inwardly deflectable sidewall 62; it is to be appreciated that one only of the pockets 60 need be provided with a deflectable side wall (this means that the primary lock means 50 would be actuated by the one sidewall 62 only in this one pocket 60). With such an arrangement, the other pocket 60 (having no inwardly deflectable side wall) becomes an optional feature.

In the above embodiments both lids 14, 16 are of dish like form. Although this is preferred it will be appreciated that one of the lids may not be dished and may for example be substantially planar.

The invention claimed is:

1. A child-resistant container comprising;

(a) a first and second lid attached by a hinge, wherein the first and second lids define a cavity when the lids are closed;

(b) a primary lock means comprising a first and a second lock assembly oriented such that the first lock assembly is located on a peripheral wall that defines an exterior of the container and the second lock assembly is located on the peripheral wall that defines the exterior of the container on the side opposite to the first lock assembly;

(c) a secondary lock means located on an end of the container opposite of the hinge and wherein the secondary lock means is independent of the primary lock means;

wherein the primary lock means further comprises a primary lock actuation means comprising a first and a second pocket positioned in the second lid in side-by-side orientation;

wherein each of the first and second lock assemblies of the primary lock means comprise a first latch extending from the peripheral wall of the container and a second latch extending from an end of a side wall of the first or second pockets of the primary lock actuation means such that the first and second latches engage when the lids are closed;

wherein the side walls of the first and second pockets comprise a tongue that is resiliently deflectable and extends at an obtuse angle relative to the peripheral wall such that the tongue extends toward the peripheral wall of the container to allow the second latch to engage the first latch of the primary lock assembly; and wherein the first and second latches are not exposed to the outside of the container.

2. The container of claim 1, wherein the first and second lock assemblies include first and second co-operable hook shaped latch members.

3. The container of claim 1, wherein the first and second lids comprise a plurality of laterally extending reinforcement ribs which are arranged to resist inward deflection of the lid's peripheral side wall relative to the lid's bottom wall.

4. The container of claim 3, wherein one or more of the plurality of reinforcement ribs has side projections that project beyond the top edge of the side wall, each side projection lying in face contact with the inner face of the side wall of the opposed lid when in the container closed position in order to resist relative lateral displacement between the lids.

5. The container of claim 4, wherein one or more of the plurality of reinforcement ribs of the first and/or second lids are adapted to define a cradle for locating and mounting an article to be contained in the container.

* * * * *